United States Patent [19]

Goda

[11] Patent Number: 4,646,071

[45] Date of Patent: Feb. 24, 1987

[54] INFRARED-RAY SENSITIVE ALARM DEVICE BUILT INTO ELECTRONIC EQUIPMENT

[75] Inventor: Mamoru Goda, Akashi, Japan

[73] Assignee: Coney Onkyo Company, Ltd., Kobe, Japan

[21] Appl. No.: 723,470

[22] Filed: Apr. 15, 1985

[30] Foreign Application Priority Data

May 7, 1984 [JP] Japan ..... 59-66840[U]

[51] Int. Cl.[4] ..... G08B 13/18

[52] U.S. Cl. ..... 340/693; 250/340; 340/567

[58] Field of Search ..... 340/693, 567; 250/340, 250/338 R

[56] References Cited

U.S. PATENT DOCUMENTS

| | | | |
|---|---|---|---|
| 3,703,718 | 11/1972 | Berman | 340/567 |
| 3,908,180 | 9/1975 | Braginsky | 340/693 |
| 4,523,095 | 6/1985 | Keller-Steinbach | 340/567 |
| 4,551,711 | 11/1985 | Akiyama et al. | 340/567 |

*Primary Examiner*—Glen R. Swann, III

*Attorney, Agent, or Firm*—Fidelman, Wolffe & Waldron

[57] ABSTRACT

An alarm device is built into electrical equipment such as a portable radio receiver or tape recorder and connected to a loud speaker unit for producing an alarm sound by sensing infrared rays emitted from an intruder and sensed by an infrared ray detector included therein.

3 Claims, 8 Drawing Figures

INFRARED-RAY SENSITIVE ALARM DEVICE BUILT INTO ELECTRONIC EQUIPMENT

This invention relates to an alarm device of an infrared ray detection type and, especially to a device which is suitable to be built into electrical equipment, such as a tape recorder or radio receiver for warning the presence of an intruder.

INTRODUCTION

U.S. Pat. No. 4,222,119 granted to H. Brunner-Schwer on Sept. 9, 1980 discloses a portable radio receiver having an ultrasonic wave transmitter and receiver built therein for emitting an ultrasonic wave and sensing the wave reflected back from an intruder to actuate a low frequency oscillator also built therein. Such an ultrasonic type alarm device incurs a problem in that it must include an ultrasonic wave transmitter and receiver which complicate the circuit configuration. An infrared ray type alarm device which senses infrared rays emitted from an intruder to actuate a built-in low frequency oscillator appears advantageous for this purpose, since it needs no transmitter. However, it has been found that such an infrared ray type alarm device has a severe problem in that the infrared rays coming into a cabinet are disturbed by convection produced by heat emitted from built-in electric components, thereby causing erroneous operation.

Accordingly, an object of this invention is to provide an improved infrared ray type alarm device suitable for use in electric equipment, from which the problem of convection has been removed.

Another object of this invention is to provide such an alarm device which is simply assembled.

BRIEF STATEMENT OF THE INVENTION

In accordance with this invention, the alarm device comprises an inlet window formed in a surface of the cabinet or casing of electric equipment, a reflector facing the inlet window, an infrared ray detector located between the inlet window and the reflector at the focus of the reflector, a first cover disposed in front of the reflector to surround the infrared ray detector for preventing erroneous operation and a second cover extending from the front end of the first cover to the inlet window for covering the window.

DESCRIPTION OF THE INVENTION

These and other objects and features of this invention will be described in more detail below with reference to the accompanying drawings.

Figure 6:
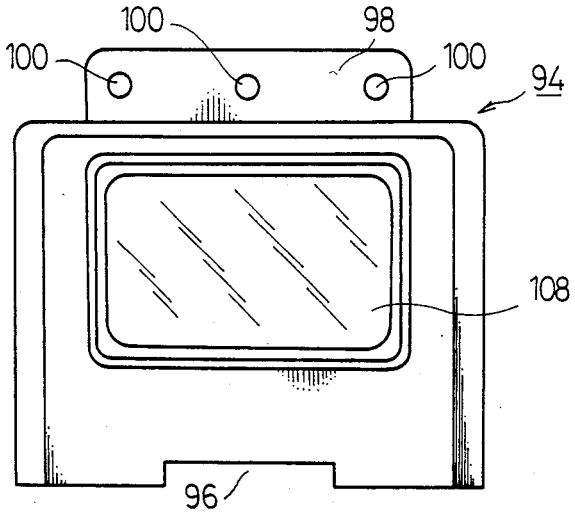
FIG. 6 is a front view of a cover used in this embodiment of the invention to prevent erroneous operation.

FIG, 7 is a left side view of the cover shown in FIG. 6 and

Figure 8:
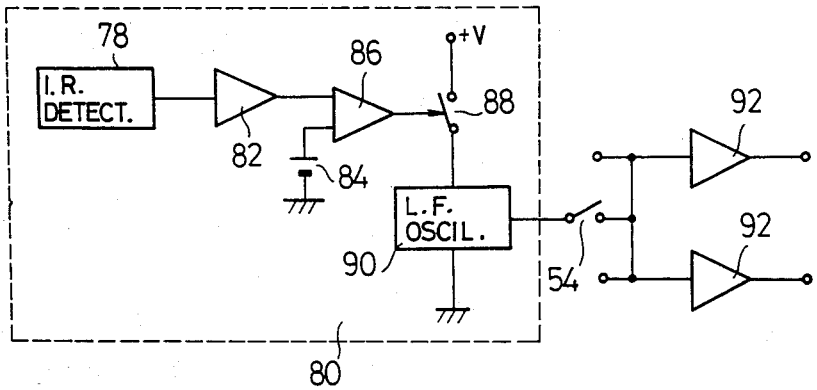

FIG. 8 is a schematic view representing a circuit configuration used in this embodiment of the invention.

Throughout the drawings, like reference numerals are used to denote like structural components.

Figure 2:
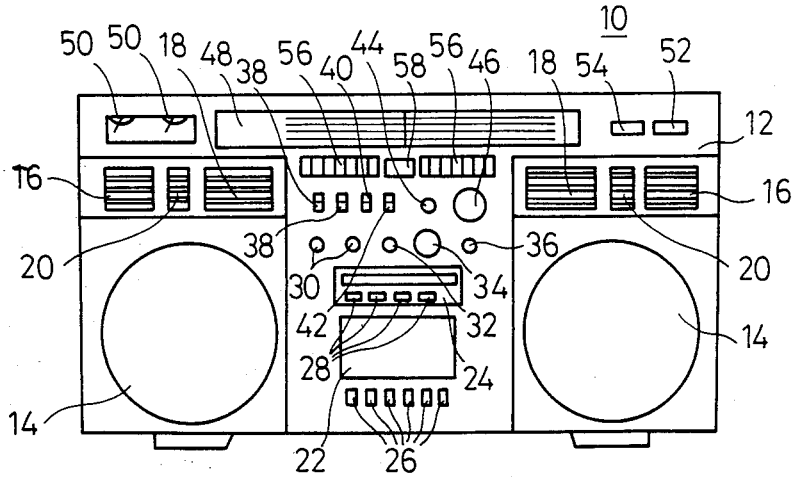
FIG. 2 is a front view of the tape recorder of FIG. 1.

Prior to describing the alarm device of this invention, reference will be made to FIG. 2 representing a dual cassette tape recorder 10 and an accompanying a stereophonic radio receiver. The tape recorder 10 includes a rectangular parallelepiped cabinet 12 of shallow depth, a pair of woofers 14 in the front panel of cabinet 12, and pairs of tweeters 16, mid-range loud speakers 18 and microphones 20 arranged above woofers 14. Two cassette racks 22 and 24 are arranged vertically between woofers 14 and push-buttons 26 and 28 are provided for operating these cassette racks 22 and 24.

There are two horizontal rows of switches and knobs, including tone control knobs 30, balance control knob 32, volume control knob 34, function change-over switch 36, tape selection switches 38, loudness switch 40, FM mute switch 42, band change-over switch 44 for the radio receiver and tuning knob 46, arranged above cassette rack 24. Above these knobs and switches, a band indication board 48 for radio receiver is disposed. A pair of level meters 50 are disposed in the lefthand side of the band indication board 48 and power supply switch 52 and alarm enabling switch 54 are disposed in the righthand side thereof. A pair of power indicators 56 are disposed under band indication board 48 and an alarm device 58 is disposed between these power indicators 56.

Figure 1:
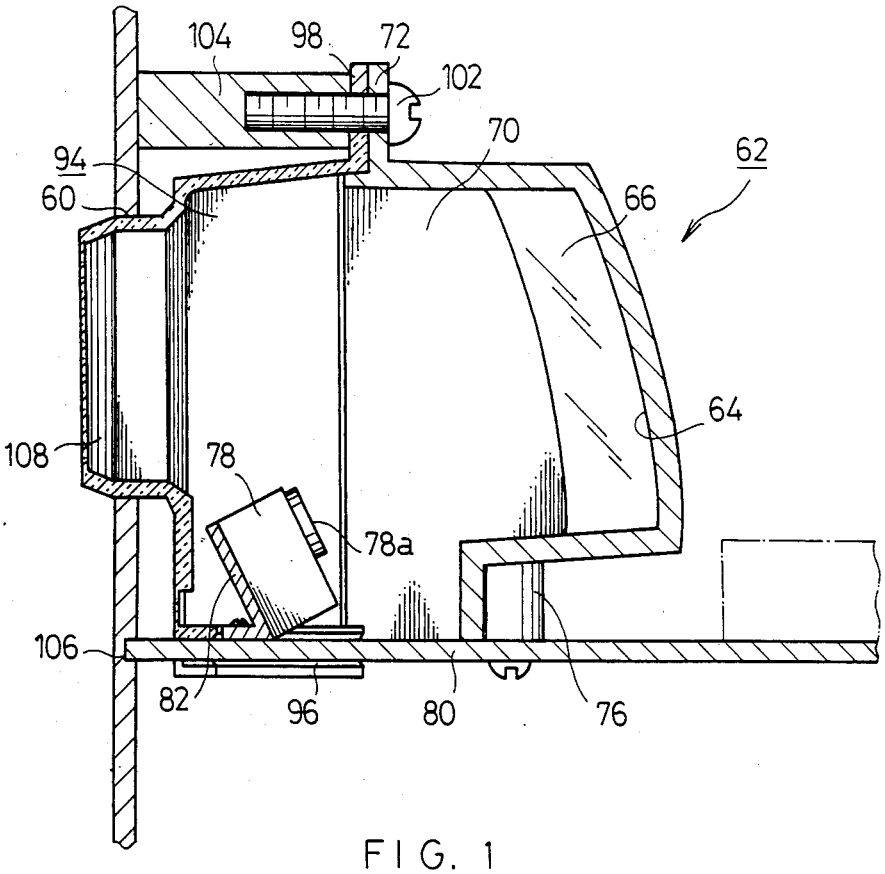
FIG. 1 is an axial cross sectional view of an embodiment of the alarm device of this invention, which is built in a dual cassette tape recorder accompanied by a stereophonic radio receiver.
Figure 3:
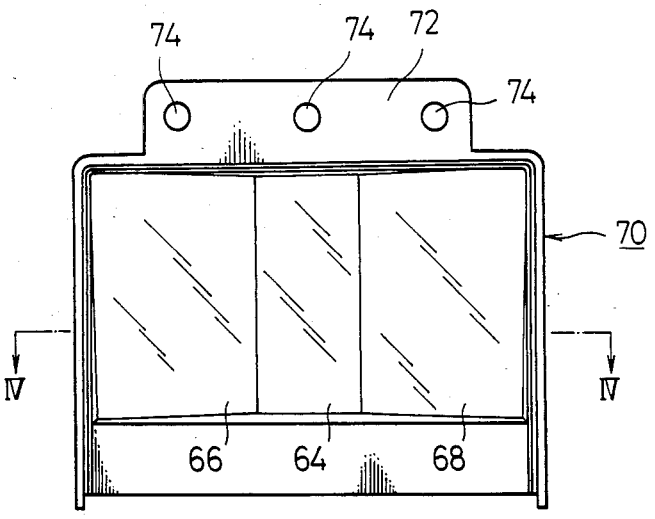
FIG. 3 is a front view of a reflector used in the embodiment of FIG. 1.
Figure 4:
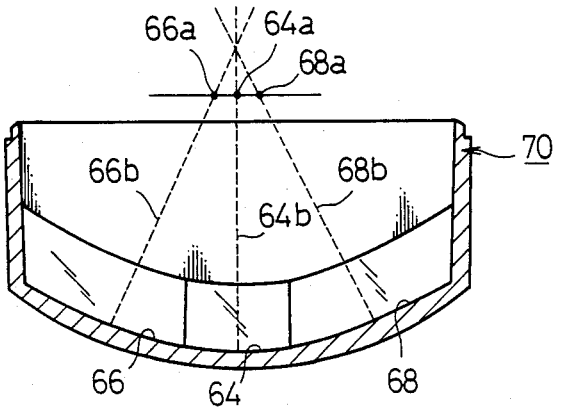
FIG. 4 is a cross sectional view along a line IV—IV of FIG. 3.
Figure 5:
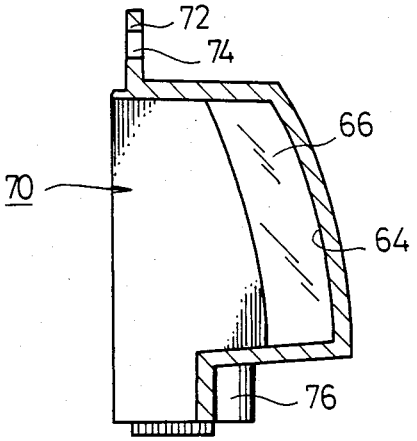
FIG. 5 is an axial cross sectional view of the reflector used in this embodiment.

As shown in FIG. 1, the alarm device 58 fits in a rectangular inlet aperture 60 formed in cabinet 12 between power indicators 56. Within cabinet 12, a reflector 62 is disposed facing the aperture 60. As shown in FIG. 3, this reflector 64 consists of a central mirror 64 and left and right mirrors 66 and 68 arranged on the both sides of central mirror 64. As shown in FIGS. 4 and 5, these mirrors are composed of separate paraboloids of revolution which are designed and arranged such that their axis of revolution **64*b*, 66*b* and 68*b* exist in a common horizontal plane and intersect mutually at a point and their focuses 64*a*, 66*a* and 68*a* are aligned on a horizontal line, in symmetrical relationship about a vertical plane including the axis 64*b*. A frame wall 70 is provided at the front side of reflector 62 for surrounding the same and a flange 72 having bolt holes 74 is formed at the top edge thereof. A boss 76 is formed at the bottom of frame wall 70 for attaching a printed circuit board 80 as shown in FIG. 1**.

A commercially available infrared ray detector 78 is mounted on the printed circuit board 80 through a fixture member 82 such that the focuses **64*a*, 66*a* and 68*a* of paraboloid mirrors 64, 66 and 68 are located on the light sensing surface 78*a* of detector 78. Behind the reflector 62, as shown in phantom in FIG. 1, various circuit components of alarm device are mounted on printed circuit board 80. As shown in FIG. 8, these components include an amplifier 82 for amplifying the output signal of infrared ray detector 78. A reference signal source 84, a comparator 86 for comparing the output signal of detector 78 with the reference level of signal source 84 to provide an output signal when the former level exceeds the latter, normally-open switch 88 closed in response to the output signal of comparator 86 and low frequency oscillator 90 connected in series with switch 88. The output signal of oscillator 90 is supplied through alarm enabling switch 54 to power amplifiers 92 which amplify the input signal and supply it to woofers 14, tweeters 16 and mid-range speakers 18**.

The front end of frame wall 70 of reflector 62 is coupled to an erroneous operation preventing cover 94. The cover 94 has the shape of a rectangular box open at the back and surrounding the infrared ray detector 78, and is provided with a slot 96 at the bottom for insertion of printed circuit board 80 and a flange 98 having bolt holes 100 corresponding to the aforementioned bolt holes 74, at the top, as shown in FIG. 6. As shown in FIG. 1, reflector 62 and cover 94 are fixed to the front panel of cabinet 12 through a bracket 104 by bolts 102 passing through bolt holes 74 and 100. In this state, the front edge of printed circuit board 80 fits in a positioning groove 106 formed in the back face of the front panel of cabinet 12.

Figure 7:
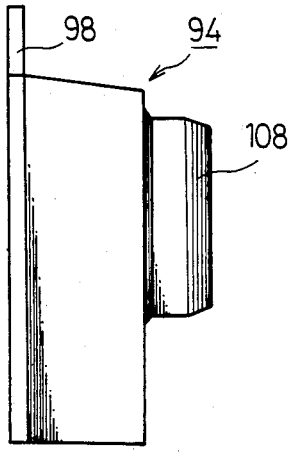

As shown in FIG. 7, as well as FIG. 1, a part of the front wall of cover 94 extends forwardly to fit in the rectangular opening 60 in the front panel of cabinet 12 to form an infrared ray inlet window 108. The cover 94 and window 108 may be formed integrally of suitable resin such as polyethylene having high transparency to infrared ray.

As described above, the infrared ray detector 78 and reflector 62 are tightly enclosed and thermally isolated from the other elastic components which may produce heat, so that their infrared ray detecting operation is not affected by such heat. Moreover, the integrity of cover 94 and window 108 makes it easy to assemble the device, together with printed circuit board 80 carrying all electrical components of the device. While, in the above embodiment, reflector 62 is composed of three paraboloid mirrors 64, 66 and 68 having their focuses at separate points, the purpose of this design is to increase the viewing field of detector 78 and the reflector 62 may be composed of a single mirror.

What is claimed is:

1. An alarm device built into the cabinet of a utilization device having an opening; comprising a reflector having at least one focus, an inlet window fitting in said opening and facing said reflector, an infrared ray detector disposed at the focus of said reflector and between said window and said reflector, and a cover wall disposed between said window and said reflector for enclosing said detector to prevent its erroneous operation.

2. An alarm device, according to claim 1, wherein said window is formed integrally with said cover wall and extends from the front face of said cover wall into said opening.

3. An alarm device according to claim 1 wherein said reflector comprises three adjoining mirrors composed of separate paraboloids of revolution with their axes in a common plane and intersecting at a point and said detector has a sensing surface coincident with said point.

* * * * *